US011028642B2

(12) United States Patent
Lei et al.

(10) Patent No.: US 11,028,642 B2
(45) Date of Patent: Jun. 8, 2021

(54) ROLLER SHADE ACTUATION DEVICE

(71) Applicant: Leafy Windoware Co., Ltd., Dongguan (CN)

(72) Inventors: Zhenbang Lei, Guangdong (CN); Xingbang Lei, Guangdong (CN)

(73) Assignee: Leafy Windoware Co., Ltd., Dongguan (CN)

( * ) Notice: Subject to any disclaimer, the term of this patent is extended or adjusted under 35 U.S.C. 154(b) by 177 days.

(21) Appl. No.: 16/345,738

(22) PCT Filed: Jul. 10, 2017

(86) PCT No.: PCT/CN2017/092402

§ 371 (c)(1),
(2) Date: Apr. 29, 2019

(87) PCT Pub. No.: WO2018/223483

PCT Pub. Date: Dec. 13, 2018

(65) Prior Publication Data

US 2019/0257149 A1 Aug. 22, 2019

(30) Foreign Application Priority Data

Jun. 6, 2017 (CN) ..... 201720650541.8

(51) Int. Cl.

| | |
|---|---|
| ***E06B 9/60*** | (2006.01) |
| ***E06B 9/42*** | (2006.01) |
| ***E06B 9/68*** | (2006.01) |
| ***A47H 5/02*** | (2006.01) |

(52) U.S. Cl.

CPC ..... *E06B 9/60* (2013.01); *A47H 5/02* (2013.01); *E06B 9/42* (2013.01); *E06B 9/68* (2013.01)

(58) Field of Classification Search

CPC ..... E06B 9/42; E06B 9/60; E06B 9/68
See application file for complete search history.

(56) References Cited

U.S. PATENT DOCUMENTS

2007/0253768 A1* 11/2007 Li ..... F16D 1/12 403/305
2009/0205793 A1* 8/2009 Cheng ..... E06B 9/322 160/405
2014/0262069 A1* 9/2014 Drew ..... E06B 9/44 160/120
2016/0130870 A1* 5/2016 Cheng ..... E06B 9/42 160/309
2019/0257147 A1* 8/2019 Lei ..... E06B 9/72

FOREIGN PATENT DOCUMENTS

WO WO-03106803 A1 * 12/2003 ..... E06B 9/54

* cited by examiner

*Primary Examiner* — Beth A Stephan

(57) ABSTRACT

An embodiment of the present invention provides a roller shade actuation device for actuating a winding drum with an outer surface mounted with an end of a shade body. Opposite ends of the winding drum are rotatably mounted to corresponding frames with the help of pivots. The roller shade actuation device is mounted between one of the frames and the winding drum. The roller shade actuation device includes a middle shaft rotatably mounted to an inner sidewall of the frame, and a plane scroll spring mounted outside the middle shaft and axially parallel to the middle shaft. The middle shaft is connected to a pivot of a corresponding end of the winding drum through shaft connection. An outer end of a reed of the plane scroll spring is fixed to an outer surface of the middle shaft.

10 Claims, 5 Drawing Sheets

ROLLER SHADE ACTUATION DEVICE

BACKGROUND OF THE INVENTION

1. Field of the Invention

The present invention relates to window shade technical field and, more particularly to a roller shade actuation device.

2. Description of Related Art

Roller shades are a type of curtain products that roll shade bodies on winding drums to form rollers and use cords or chains to do up-and-down controls, which are easy to operate, and among which, there is a roller shade which is called a spring roller shade due to a built-in spring device of a winding drum, also known as a semi-automatic roller shade.

Opposite ends of a winding drum of a current spring roller shade are mounted to corresponding brackets, and a spring end, a coil spring, a damper, and a limiter are arranged in order from an end to an opposite end in the winding drum. When the shade body needs to be put down, the shade body only needs to be pulled down, and the shade body will drive the winding drum to rotate and then rotate relative to the coil spring. The coil spring is twisted and deformed to accumulate elastic force. At the same time, by means of the damper, the shade body can be held at any height position within the effective range of the shade body. When the shade body needs to be rolled up, the shade body only needs to be pushed up, and the force of the coil spring overcomes the damping action of the damper to drive the winding drum to rotate in an opposite direction, thereby rewinding the shade body on the winding drum. The current spring roller shade uses the coil spring, and the whole coil spring is deformed during the action, which makes the generated elastic force difficult to be controlled effectively. When the elastic force is too large, it is easy to make the shade body rise rapidly, causing a lower supporting pole to hit an upper beam, and the damper has to be added to slowly release the elastic force of the coil spring, which will leads to relatively complicated structures, and high costs of components and assembly.

SUMMARY OF THE INVENTION

Therefore, the technical problem to be solved by the embodiments of the present invention is to provide a roller shade actuation device, which is capable of smoothly actuating the roller shade to be retracted or released.

To solve the above-mentioned technical problems, an embodiment of the present invention provides a roller shade actuation device for actuating a winding drum with an outer surface mounted with an end of a shade body and opposite ends rotatably mounted to corresponding frames with the help of pivots, and the actuation device is mounted between one of the frames and the winding drum, the roller shade actuation device includes a middle shaft rotatably mounted to an inner sidewall of the frame, a plane scroll spring mounted outside the middle shaft and axially parallel to the middle shaft, and a pivot relatively fixed in a circumferential direction with the end of the winding drum, and connected to the middle shaft through shaft connection, an outer end of a reed of the plane scroll spring is fixed to an outer surface of the middle shaft.

Furthermore, the inner sidewall of the frame forms at least one pole, each of the at least one pole is fitted about one said plane scroll spring, the outer ends of the reeds of the plane scroll springs are fixed to different positions of the outer surface of the middle shaft.

Furthermore, the pole is fitted about a bushing, and the plane scroll spring is fitted about the bushing.

Furthermore, the pivot includes an insertion end for being inserted into an inner cavity of the corresponding end of the winding drum, and a connection shaft located at an end of the insertion end away from the winding drum; the insertion end is mutually engaged with an inner wall of the inner cavity of the winding drum to allow the insertion end and the winding drum to be relatively fixed in the circumferential direction; the insertion end forms a limit piece for being abutted against an outer end surface of the winding drum, the connection shaft is connected to the middle shaft through shaft connection.

Furthermore, an end wall of an end of the middle shaft facing the winding drum defines a connection hole, the connection shaft is inserted into the connection hole, cross sections of the connection hole and the connection shaft are matched and are non-circular to allow the winding drum and the connection shaft to be relatively fixed in the circumferential direction, or a fixing pin extends into the connection hole through a sidewall of the middle shaft to be inserted into the connection shaft, so as to fixedly connect the connection shaft and the middle shaft.

Furthermore, the frame defines a round hole, an end of the middle shaft is cylindrical and inserted into the round hole; an end wall of the end of the middle shaft inserted into the round hole defines a non-circular operation hole.

Furthermore, the insertion end is a hollow tube and only opens at an end adjacent to the connection shaft, the connection shaft is inserted into the tube, cross sections of the connection shaft and an inner tube hole of the tube are matched and are non-circular.

Furthermore, a wall of the tube defines a slot extending through the wall of the tube and extending along an axial direction of the tube; the connection shaft forms a hook engaged in the slot, a compressed spring is arranged in the tube and resiliently abutted against the end of the connection shaft inserted into the tube.

Furthermore, an inner wall of the winding drum protrudes toward a center of the inner cavity of the winding drum to form a protrusion, an outer wall of the insertion end correspondingly defines an insertion slot, when the insertion end is inserted into the inner cavity of the winding drum, the protrusion is correspondingly engaged in the insertion slot.

Furthermore, the roller shade actuation device further includes a cover mounted to the inner sidewall of the frame rotatably mounted with the middle shaft, the cover and the frame cooperate to form a closed mounting cavity, the middle shaft and the plane scroll spring are mounted in the mounting cavity, and the cover defines a through hole for exposing the middle shaft.

By adopting the above-mentioned technical solutions, the beneficial effects of the embodiments of the present invention are as follows. By providing the roller shade actuation device between one of the frames and the winding drum, and using the planar scroll spring to provide an actuation force, the actuation force required for the winding of the shade body can be better designed. Moreover, the overall structure is simple, easy to assemble and easy to handle.

DETAILED DESCRIPTION OF THE INVENTION

Figure 1:
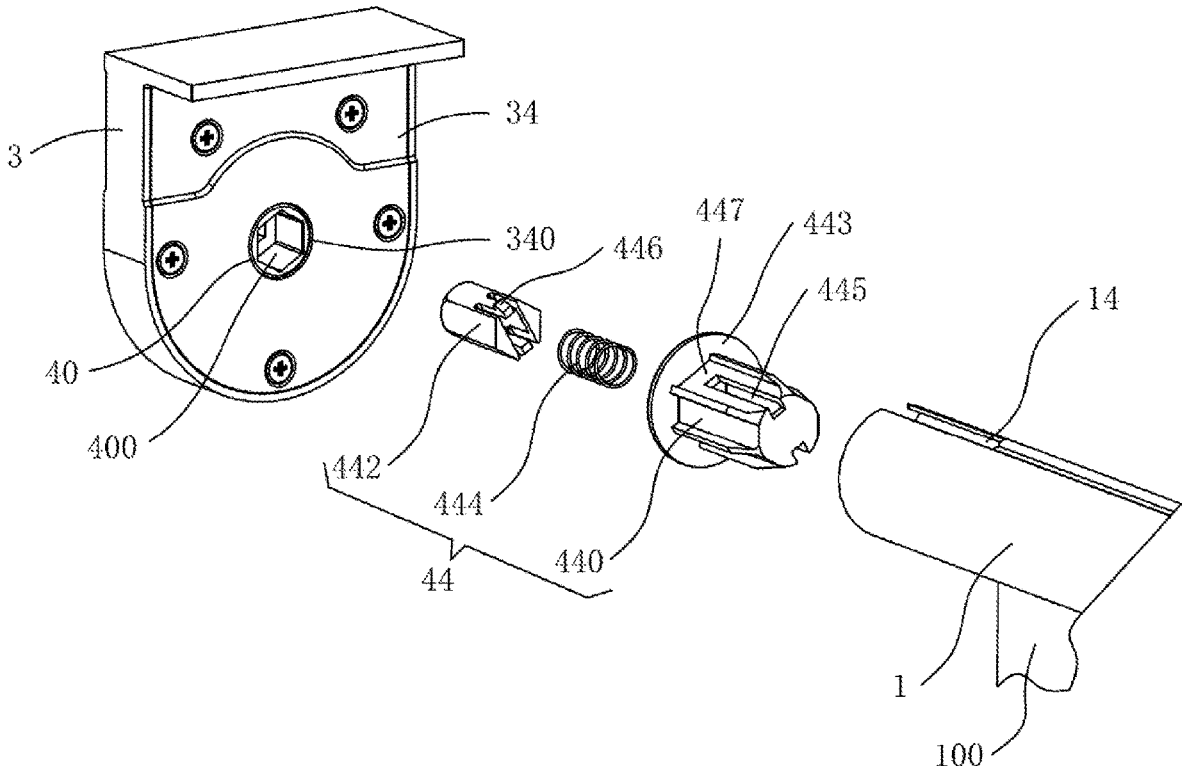
FIG. 1 is a partially exploded, isometric view of an embodiment of a shade actuation device of the present invention.
Figure 2:
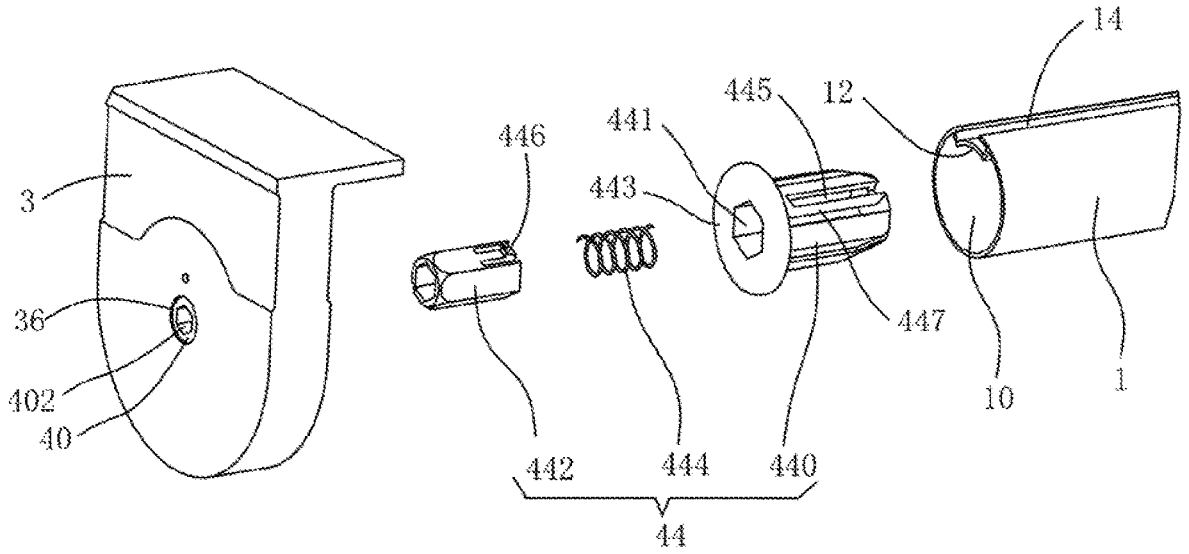
FIG. 2 is a partially exploded, isometric view of the embodiment of the shade actuation device of the present invention, but viewed from another perspective.

The present application will be further described in detail below with reference to the accompanying drawings and specific embodiments. It should be understood that the following illustrative embodiments and illustrations are only used to explain the present invention and are not intended to limit the invention, and that the embodiments of the present invention and the features of the embodiments can be combined with each other without conflict.

Referring to FIGS. 1-4, an embodiment of the present disclosure provides a roller shade actuation device for actuating a winding drum 1 with an outer surface mounted with an end of a shade body 100. Opposite ends of the winding drum 1 are rotatably mounted to corresponding frames 3. The roller shade actuation device is mounted between one of the frames 3 and the winding drum 1, and includes a middle shaft 40 rotatably mounted to an inner sidewall of the frame 3, a plane scroll spring 42 mounted outside the middle shaft 40 and axially parallel to the middle shaft 40, and a pivot 44 relatively fixed in a circumferential direction with the end of the winding drum 1. The middle shaft 40 is connected to the pivot 44 through shaft connection. An outer end of a reed of the plane scroll spring 42 is fixed to an outer surface of the middle shaft 40.

In the embodiment, by providing the actuation device between one of the frames 3 and the winding drum 1, and using the plane scroll spring 42 to provide an actuation force, the actuation force required for the shade body to be retracted or released can be better designed. The overall structure is simple, and is easy to be assembled and manipulated.

Figure 5:
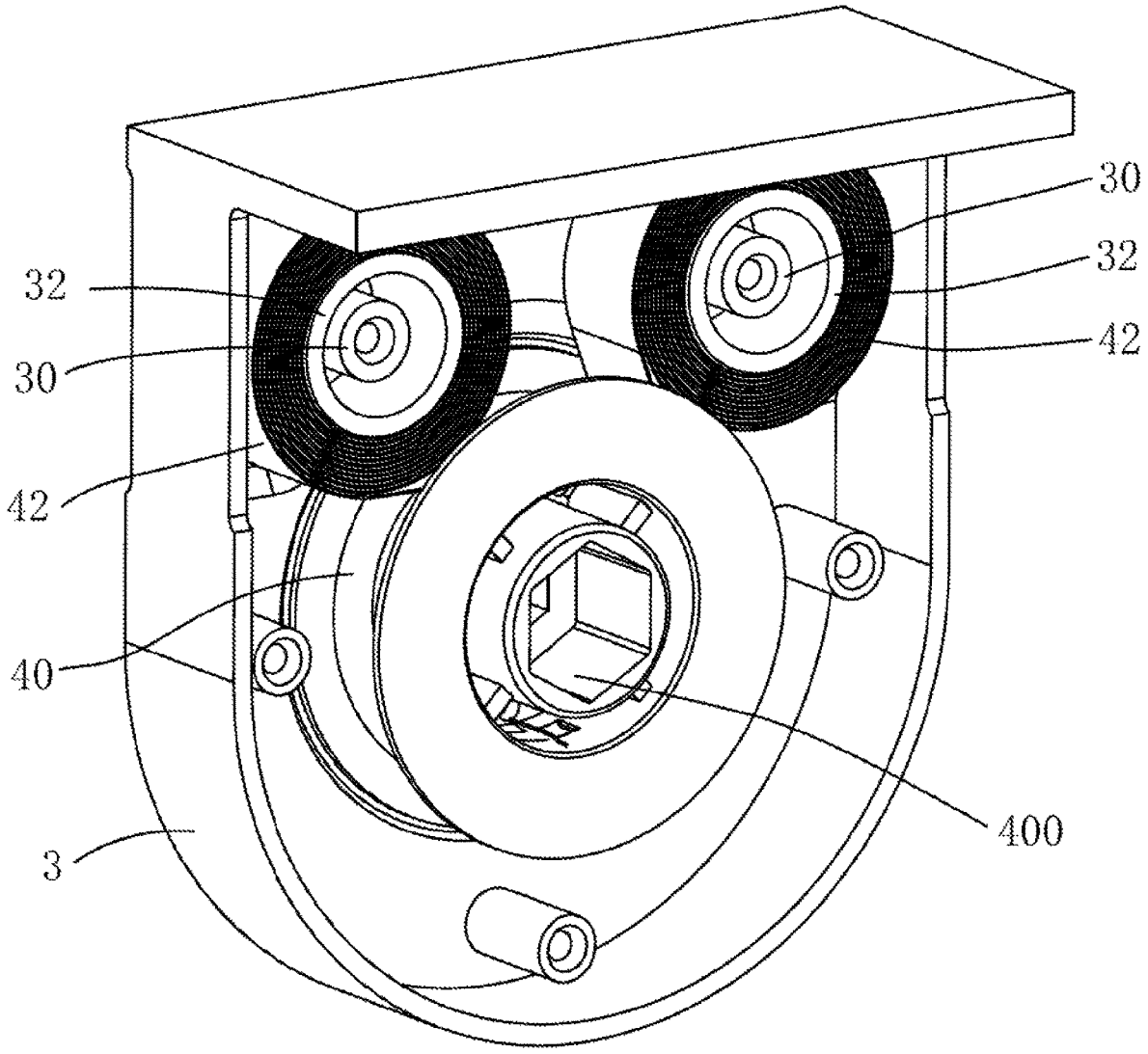
FIG. 5 is a schematic view of another embodiment of the roller shade actuation device.

In an embodiment of the present invention, the inner sidewall of the frame 3 is mounted with at least one pole 30. Each pole 30 is fitted about one said plane scroll spring 42. The outer ends of the reeds of the plane scroll springs 42 are fixed to different positions of the outer surface of the middle shaft 40. For example, in the embodiment shown in FIG. 4, one plane scroll spring 42 is assembled, while in the embodiment shown in FIG. 5, two plane scroll springs 42 are assembled. In the embodiment, the middle shaft 40 can be actuated together by providing a plurality of plane scroll springs 42, which can more flexibly design the corresponding actuation force distribution of the shade body at different height positions according to the width and the weight of the shade body, and can also facilitate the design and manufacture of the planar scroll springs 42 and reduce costs. In an embodiment shown in FIG. 4, the pole 30 is fitted about a bushing 32. The plane scroll spring 42 is fitted about the bushing 32. By adding the bushing 32, it is possible to adapt to the plane scroll springs 32 of different inner diameters, in particular to avoid noise problems caused by the excessive clearance between the inner diameter of the plane scroll spring 42 and the pole 30.

Figure 3:
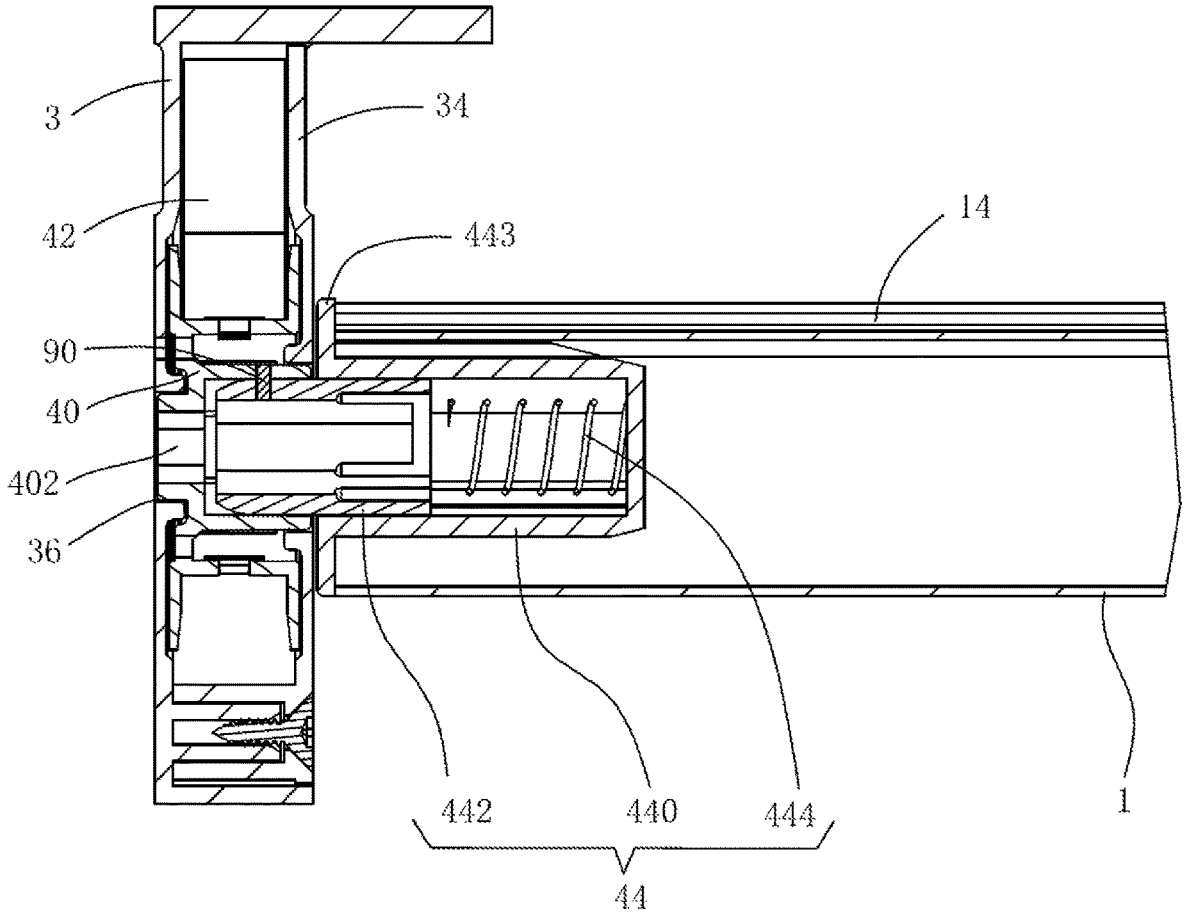
FIG. 3 is a cross-sectional view of the embodiment of the roller shade actuation device.
Figure 4:
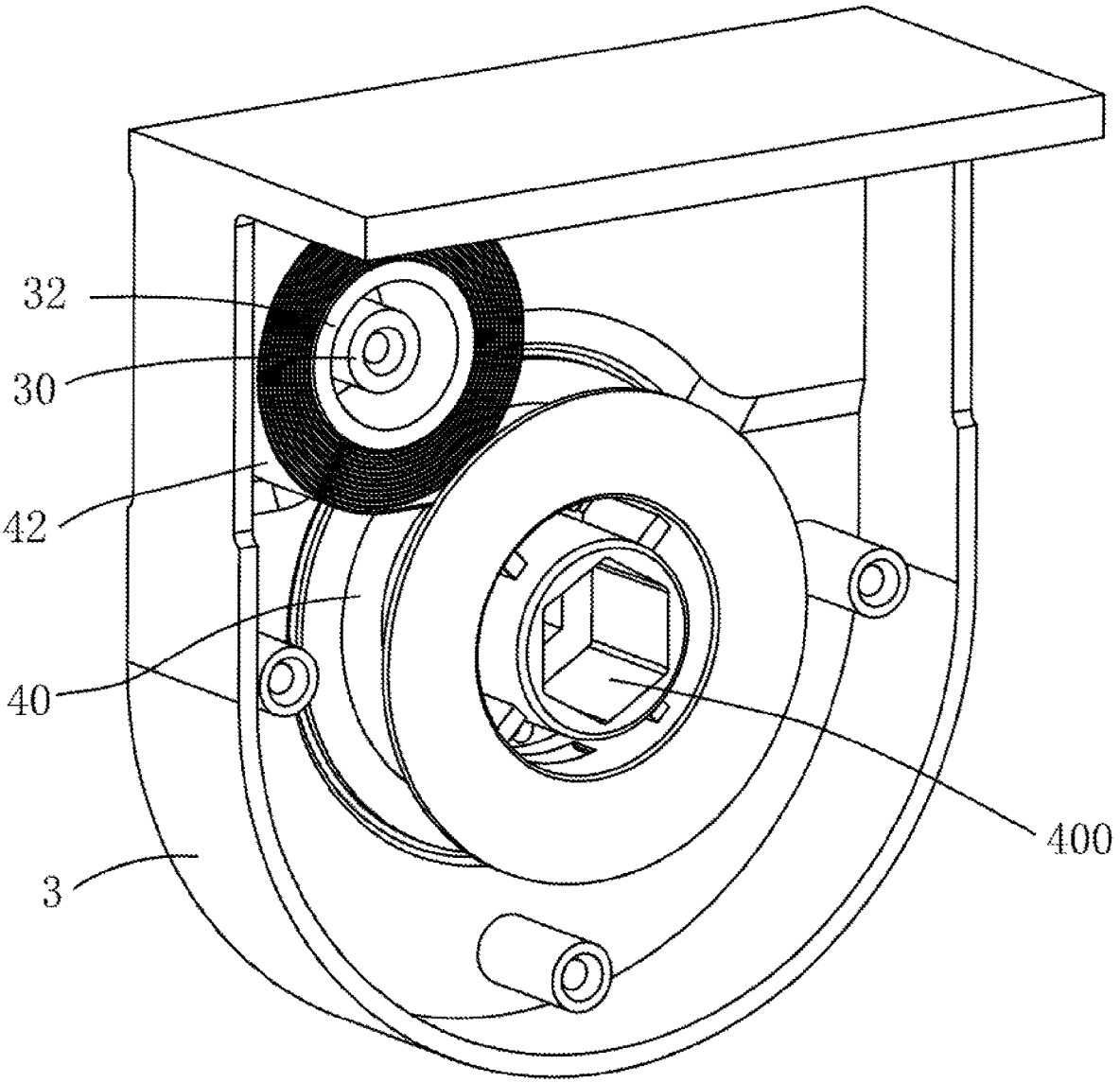
FIG. 4 is a schematic view of the embodiment of the roller shade actuation device.

Referring to FIGS. 1 and 3, the roller shade actuation device further includes a cover 34 mounted to the inner sidewall of the frame 3 rotatably mounted with the middle shaft 40. The cover 34 and the frame 3 cooperate to form a closed mounting cavity. The middle shaft 40 and the plane scroll spring 42 are mounted in the mounting cavity, and the cover 34 defines a through hole 340 for exposing the middle shaft 40. By providing the cover 34, the middle shaft 40 and the plane scroll spring 42 can be covered. The movable parts are not exposed, it can avoid the bad phenomenon, such as jamming of foreign objects falling in, and it can also make the overall structure more concise.

In another embodiment of the present invention, the pivot 44 includes an insertion end 440 for being inserted into an inner cavity 10 of a corresponding end of the winding drum 1, and a connection shaft 442 located at an end of the insertion end 440 away from the winding drum 1. The insertion end 440 is inserted into the winding drum 1 and is mutually engaged with an inner wall of the inner cavity of the winding drum 1, such that the insertion end 440 and the winding drum 1 are relatively fixed in a circumferential direction. The insertion end 440 forms a limit piece 443 for being abutted against an outer end surface of the winding drum 1. The depth of the insertion end 440 being inserted into the winding drum 1 can be effectively controlled by setting the limit piece 443. The connection shaft 442 and the middle shaft 40 correspondingly achieve the shaft connection. In the embodiment, by dividing the pivot 44 into the insertion end 440 and the connection shaft 442, it is more convenient to assemble the pivot 44 into the winding drum 1 and achieve circumferential fixing, and it is also convenient for the pivot 44 to realize the shaft connection through the connection shaft 442 and the middle shaft 40 for power transmission.

In an embodiment of the present invention, an end wall of an end of the middle shaft 40 facing the winding drum 1 defines a connection hole 400. The connection shaft 442 is correspondingly inserted into the connection hole 400. Cross sections of the connection hole 400 and the connection shaft 442 are matched and are non-circular, such as hexagonal, triangular, pentagonal, elliptical, or star-shaped. Through the non-circular cross-section design, the power transmission between the middle shaft 40 and the connection shaft 442 can be realized when the connection shaft 442 is inserted into the connection hole 400, and the power loss is small.

In another embodiment of the present disclosure, an end wall of an end of the middle shaft 40 facing the winding drum 1 defines a connection hole 400. The connection shaft 442 is correspondingly inserted into the connection hole 400. A fixing pin 90 is inserted into the connection hole 400 through a sidewall of the middle shaft 40 and inserted into the connection shaft 442 to fixedly connect the connection shaft 442 and the middle shaft 40, so that the shaft connection can also be realized, and the power transmission can be performed.

In an embodiment of the present invention, the frame 3 defines a round hole 36. An end of the middle shaft 40 is cylindrical and is inserted into the round hole 36, and an end wall of the end of the middle shaft 40 inserted into the round hole 36 defines an operation hole 402 with a non-circular cross section. By exposing the end wall of the middle shaft 4 through the round hole 36 of the frame 3, and defining the operation hole 402 with the non-circular cross section in the end wall of the middle shaft 4, the rotation of the middle shaft can be driven by inserting a tool into the operation hole 402 when necessary, to realize the pre-winding operation of the plane scroll spring 42.

In another embodiment of the present invention, the insertion end 440 of the pivot 44 is a hollow tube and only opens at an end adjacent to the connection shaft 442. The connection shaft 442 is inserted into the tube. Cross sections of the connection shaft 442 and an inner tube hole 441 of the tube are matched and are non-circular, such as hexagonal, triangular, pentagonal, elliptical, or star-shaped. Through the non-circular cross-section design, the power transmission between the insertion end 440 and the connection shaft 442 can be realized when the connection shaft 442 is inserted into the tube, and then the insertion end 440 drives the winding drum to rotate. Moreover, this connection method has low loss during power transmission.

In a further embodiment of the present invention, a wall of the tube defines a plurality of slots 445 extending through the wall of the tube and extending along an axial direction of the tube. The connection shaft 442 correspondingly forms a plurality of hooks 446 engaged in the corresponding slots 445. A compressed spring 444 is arranged in the tube and resiliently abutted against the end of the connection shaft 442 inserted into the tube. In the embodiment, by the cooperation of the hooks 446 and the slots 445, and the pressing action of the compression spring 444, the connection shaft 442 can be more stably inserted into the corresponding connection hole 400 of the middle shaft 40. Moreover, when installing the roller shade, the connection shaft 442 can be pushed back into the tube by applying a force to the hooks 446 against a pushing force of the compression spring 444, and the winding drum 1 can be assembled conveniently. When the pivot of the other end of the winding drum 1 is correspondingly inserted into a corresponding pivot hole, and the connection shaft 442 is aligned with the connection hole 400 of the middle shaft 40, the force applied to the hooks 446 is cancelled, and the compression spring 444 acts to push the connection shaft 442 into the connection hole 400 of the middle shaft 40.

In an alternative embodiment of the present invention, an inner wall of the winding drum 1 protrudes toward a center of the inner cavity 10 to form a protrusion 12. An outer wall of the insertion end 440 of the pivot 44 correspondingly defines an insertion slot 447. When the insertion end 440 is inserted into the inner cavity of the winding drum 1, the protrusion 12 is correspondingly engaged in the insertion slot 447, to realize the circumferential fixing. In a further embodiment, a position of an outer wall of the winding drum 1 corresponding to the protrusion 12 is depressed in to form a mounting slot 14 for fixing the end of the shade body, and a width of an opening of the mounting slot 14 is less than a slot width of the mounting slot 14, thereby conveniently assembling the end of the shade body.

In the retracting or releasing operation of the roller shade using the roller shade actuation device of the present invention, the balance between the actuation force supplied by the original plane scroll spring 42, and the weight of the shade body and the frictional resistance is broken by simply pulling down or pushing up the shade body, and the operation of releasing or retracting the shade body can be easily achieved. Moreover, when the shade body is driven to stay at any height position within the effective forming range, a new balance can be obtained between the actuation force provided by the plane scroll spring 42, and the weight of the shade body and the frictional resistance, even if the force applied to the shade body is removed, and the curtain can still remain at this height.

The specific embodiments described above further explain the objectives, technical solutions, and beneficial effects of the present invention. It is to be understood that the foregoing description is only specific embodiments of the present invention, and is not intended to limit the scope of the present invention. Any modifications, equivalent substitutions, improvements made within the spirit and scope of the present invention are intended to be included in the scope of the present invention.

What is claimed is:

1. A roller shade actuation device for actuating a winding drum with an outer surface mounted with an end of a shade body and opposite ends rotatably mounted to corresponding frames with the help of pivots, the actuation device mounted between one of the frames and the winding drum, the roller shade actuation device comprising:

a middle shaft rotatably mounted to an inner sidewall of the one of the frames;

a plane scroll spring mounted outside the middle shaft and axially parallel to the middle shaft; and a pivot fixed in a circumferential direction with one of the ends of the winding drum, and coaxially connected to the middle shaft;

wherein an outer end of a reed of the plane scroll spring is fixed to an outer surface of the middle shaft.

2. The roller shade actuation device of claim 1, wherein the inner sidewall of the one of the frames forms a pole, the pole is fitted about the plane scroll spring.

3. The roller shade actuation device of claim 2, wherein the pole is fitted about a bushing, and the plane scroll spring is fitted about the bushing.

4. The roller shade actuation device of claim 1, wherein the pivot comprises an insertion end for being inserted into an inner cavity of the one of the ends of the winding drum, and a connection shaft located at an end of the insertion end away from the winding drum; the insertion end is mutually engaged with an inner wall of the inner cavity of the winding drum to allow the insertion end and the winding drum to be fixed in the circumferential direction; the insertion end forms a limit piece for being abutted against an outer end surface of the winding drum, the connection shaft is coaxially connected to the middle shaft.

5. The roller shade actuation device of claim 4, wherein an end wall of an end of the middle shaft facing the winding drum defines a connection hole, the connection shaft is inserted into the connection hole, cross sections of the connection hole and the connection shaft are matched and are non-circular to allow the winding drum and the connection shaft to be fixed in the circumferential direction, or a fixing pin extends into the connection hole through a sidewall of the middle shaft to be inserted into the connection shaft, so as to fixedly connect the connection shaft and the middle shaft.

6. The roller shade actuation device of claim 4, wherein the one of the frames defines a round hole, an end of the middle shaft is cylindrical and inserted into the round hole; an end wall of the end of the middle shaft inserted into the round hole defines a non-circular operation hole.

7. The roller shade actuation device of claim 4, wherein the insertion end is a hollow tube and only opens at an end adjacent to the connection shaft, the connection shaft is inserted into the tube, cross sections of the connection shaft and an inner tube hole of the tube are matched and are non-circular.

8. The roller shade actuation device of claim 7, wherein a wall of the tube defines a slot extending through the wall of the tube and extending along an axial direction of the tube; the connection shaft forms a hook engaged in the slot, a compressed spring is arranged in the tube and resiliently abutted against the end of the connection shaft inserted into the tube.

9. The roller shade actuation device of claim 4, wherein an inner wall of the winding drum protrudes toward a center of the inner cavity of the winding drum to form a protrusion, an outer wall of the insertion end correspondingly defines an insertion slot, wherein when the insertion end is inserted into the inner cavity of the winding drum, the protrusion is correspondingly engaged in the insertion slot.

10. The roller shade actuation device of claim 1, further comprising a cover mounted to the inner sidewall of the one of the frames rotatably mounted with the middle shaft, wherein the cover and the one of the frames cooperate to form a closed mounting cavity, the middle shaft and the plane scroll spring are mounted in the mounting cavity, and the cover defines a through hole for exposing the middle shaft.

* * * * *